US009011199B2

(12) United States Patent
Yuasa et al.

(10) Patent No.: US 9,011,199 B2
(45) Date of Patent: Apr. 21, 2015

(54) LADY'S GARMENT WITH CUP PARTS

(76) Inventors: Masaru Yuasa, Kyoto (JP); Megumi Tachiiri, Kyoto (JP); Junko Yamaguchi, Kyoto (JP)

( * ) Notice: Subject to any disclaimer, the term of this patent is extended or adjusted under 35 U.S.C. 154(b) by 205 days.

(21) Appl. No.: 13/638,104

(22) PCT Filed: Mar. 31, 2010

(86) PCT No.: PCT/JP2010/055857
§ 371 (c)(1),
(2), (4) Date: Oct. 19, 2012

(87) PCT Pub. No.: WO2011/121759
PCT Pub. Date: Oct. 6, 2011

(65) Prior Publication Data
US 2014/0154948 A1 Jun. 5, 2014

(51) Int. Cl.
*A41C 3/00* (2006.01)
*A41C 3/10* (2006.01)
*A41C 3/14* (2006.01)

(52) U.S. Cl.
CPC .... *A41C 3/10* (2013.01); *A41C 3/14* (2013.01)

(58) Field of Classification Search
CPC ..... A41C 3/00; A41C 3/05; A41C 3/0057; A41C 3/10; A41C 3/14; A41C 3/144; A41C 3/148
USPC ..... 450/81, 38, 39, 54–57, 47, 49, 51, 52; 2/267, 268; 623/7, 8
See application file for complete search history.

(56) References Cited

U.S. PATENT DOCUMENTS

| | | | | |
|---|---|---|---|---|
| 2,342,076 A * | 2/1944 | Herbener | 450/56 |
| 2,563,241 A * | 8/1951 | Herbener | 450/55 |
| 2,834,352 A * | 5/1958 | Ullian | 450/57 |
| 3,814,107 A * | 6/1974 | Greenblatt et al. | 450/56 |
| 3,834,397 A * | 9/1974 | Birch | 450/56 |
| 6,200,195 B1 * | 3/2001 | Furuno et al. | 450/81 |

(Continued)

FOREIGN PATENT DOCUMENTS

| | | |
|---|---|---|
| CN | 101647602 A | 2/2010 |
| GB | 2462500 A | 2/2010 |

(Continued)

OTHER PUBLICATIONS

International Preliminary Report on Patentability, Application No. PCT/JP2010/055857, dated Nov. 1, 2012.

(Continued)

*Primary Examiner* — Gloria Hale

(57) ABSTRACT

Provided is a women's garment with cup parts which make bust top positions look higher, while enabling breasts to appear larger in volume. A women's garment with cup parts has a pair of cup parts, each cup part having a first shaping region for covering a nipple and pressing a breast at the time of putting the cup part on the breast and a second shaping region, located lower than the first shaping region, for pressing the breast, the second shaping region having a volume larger than that of the first shaping region, the cup part having a top on a front face side residing within the first shaping region when seen from the front face side. While the second shaping region pushes the breast up, the first shaping region further presses the pushed-up breast, so the bust top positions look higher, while the breasts appear larger in volume.

16 Claims, 8 Drawing Sheets

(56) References Cited

U.S. PATENT DOCUMENTS

| | | | | |
|---|---|---|---|---|
| 6,824,444 | B2 * | 11/2004 | Huang | 450/57 |
| 7,922,560 | B2 * | 4/2011 | Avalos-Dessner et al. | 450/39 |
| 8,672,728 | B2 * | 3/2014 | Chan | 450/54 |
| 2009/0247047 | A1 * | 10/2009 | Avalos-Dessner et al. | 450/52 |
| 2010/0041313 | A1 | 2/2010 | Castellano | |
| 2013/0303051 | A1 * | 11/2013 | Chan | 450/57 |

FOREIGN PATENT DOCUMENTS

| | | |
|---|---|---|
| JP | 08-060410 | 3/1996 |
| JP | 2005-136572 | 5/2005 |
| JP | 2005-139572 | 6/2005 |
| JP | 2006-193861 | 7/2006 |
| JP | 2010-043399 A | 2/2010 |

OTHER PUBLICATIONS

Office Action, Japanese Application No. 201080065922.0, dated Jan. 13, 2014.

European Search Report, European Application No. 10848937.8, dated Sep. 26, 2013.

Office Action, Japanese Application No. P2012-507980, dated Nov. 19, 2013.

International Search Report, Application No. PCT/JP2010/055857, dated Jun. 29, 2010.

* cited by examiner

LADY'S GARMENT WITH CUP PARTS

TECHNICAL FIELD

The present invention relates to a women's garment with cup parts.

BACKGROUND ART

In women's garments with a pair of cup parts typified by brassieres, recent years have seen those in which cup parts are provided with pads, so as to push up lower parts of breasts (lower parts on sides in particular), for example, thereby raising the breasts up on the front center side of the brassiere (see, for example, Patent Literature 1). Pushing the breasts up on the front center side by utilizing such pads has been forming a breast cleavage while making the breasts appear larger in volume.

CITATION LIST

Patent Literature

Patent Literature 1: Japanese Patent Application Laid-Open No. 2005-139572

SUMMARY OF INVENTION

Technical Problem

However, as a result of paying attention only to the volume enhancement, cleavage formation, and the like, little care has been given to the height of bust top positions. Hence, bust top positions in silhouette have not fully risen in women's garments with cup parts in recent years.

It is therefore an object of the present invention to provide a women's garment with cup parts, which can make the bust top positions look higher, while enabling the breasts to appear larger in volume.

Solution to Problem

For achieving the above-mentioned object, the inventors conducted diligent studies. As a result, simply pushing up the lower side of breasts by utilizing pads has been found to cause the breasts to increase their volume on the upper side of cup parts and thus bulge forward as well, thereby lowering the bust top positions, which has lead to the present invention.

That is, the women's garment with cup parts in accordance with the present invention is a women's garment with a pair of cup parts, each cup part having a first shaping region for covering a nipple and pressing a breast at the time of putting the cup part on the breast and a second shaping region, located lower than the first shaping region, for pressing the breast, the second shaping region having a volume larger than that of the first shaping region, the cup part having a top on a front face side residing within the first shaping region when seen from the front face side.

In this structure, the top on the front face side of the cup part resides within the first shaping region when seen from the front lace side, while the first shaping region is located at such a position as to cover a nipple at the time of putting on. Since the part of the breast lower than the nipple is pressed by the second shaping region having a volume larger than that of the first shaping region, the breast is pushed up, while the first shaping region can further press the breast to the skin side. Therefore, even when pushed up by the second shaping region, the breast is restrained from bulging forward. This can make the bust top positions look higher in silhouette, while enabling breasts to appear larger in volume.

Preferably, in the women's garment with cup parts in accordance with the present invention, a groove is formed on the skin side of the cup part between the first and second shaping regions.

When a woman wearing the women's garment with cup parts in accordance with the present invention having thus formed groove moves, the nipple tends to migrate to the groove. In this case, the nipple is located in a valley between the first and second shaping regions, so as to become more stable in position. Even in this case, the top on the front face side of the cup part is located within the first shaping region when seen from the front face side, so that the top position appears higher.

In the women's garment with cup parts in accordance with the present invention, the first and second shaping regions may be thicker parts bulging on the skin side of the cup part, the first shaping region being thinner than the second shaping region.

In this structure, the second shaping region is thicker than the first shaping region and thus can press the breast more strongly than the first shaping region does.

In the women's garment with cup parts in accordance with the present invention, the cup part may have a third region thinner than the first shaping region about the first and second shaping regions. In this structure, the cup part has three regions having different thicknesses.

Advantageous Effects of Invention

The present invention can make the bust top positions look higher, while enabling the breasts to appear larger in volume.

DESCRIPTION OF EMBODIMENTS

In the following, embodiments of the present invention will be explained with reference to the accompanying drawings.

The same constituents will be referred to with the same signs, while omitting their overlapping explanations. Upward, downward, leftward, rightward, forward, and backward directions in the specification are as seen from a wearer of the women's garment with cup parts. In the specification, "at the time of putting on" the women's garment with cup parts means the time at which the garment is put on from the state where the garment is not put on.

Figure 1:
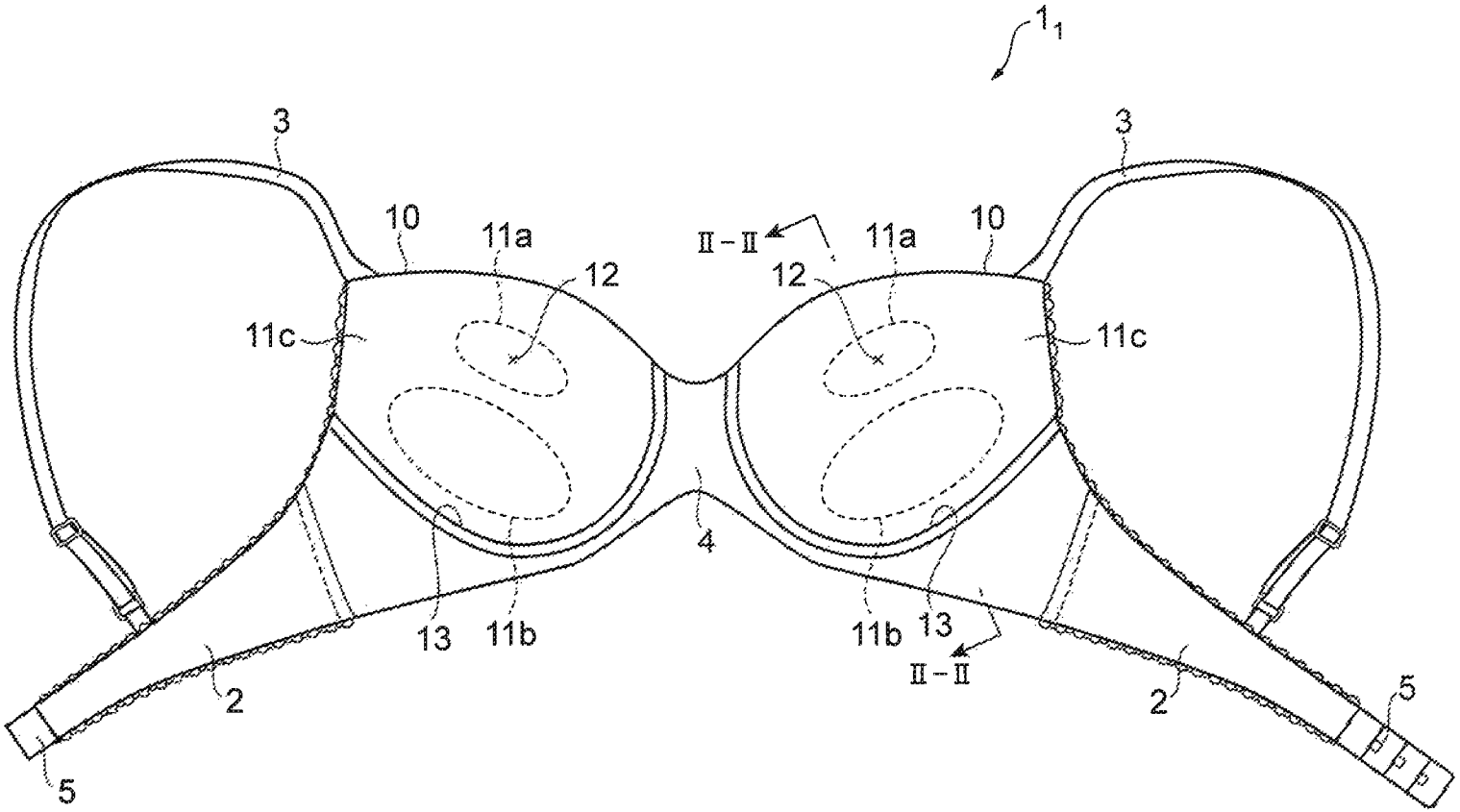
FIG. 1 is a front view of an embodiment of the women's garment with cup parts in accordance with the present invention.

FIG. 1 is a front view illustrating an embodiment of the women's garment with cup parts in accordance with the present invention. The women's garment with cup parts illustrated in FIG. 1 is a so-called brassiere $\mathbf{1}_1$.

The brassiere $\mathbf{1}_1$ includes a pair of left and right cup parts 10, 10, a pair of left and right back cloth parts 2, 2, a pair of left and right shoulder straps 3, 3, and a base part 4.

The base part 4 is sewn to lower edges of the left and right cup parts 10, 10, while its side end parts are sewn to their corresponding back cloth parts 2, 2. The pair of back cloth parts 2, 2 are constituted by a highly elastic material. The end portions of the back cloth parts 2, 2 on the sides opposite from the base part 4 are provided with respective hooks 5, 5, so that the pair of left and right back cloth parts 2, 2 are detachably fastened to each other by the hooks 5, 5. The pair of shoulder straps 3, 3 are sewn to respective upper end portions on the sides of the left and right cup parts 10, 10 and form bridges between their corresponding back cloth parts 2, 2 and cup parts 10, 10.

Figure 2:
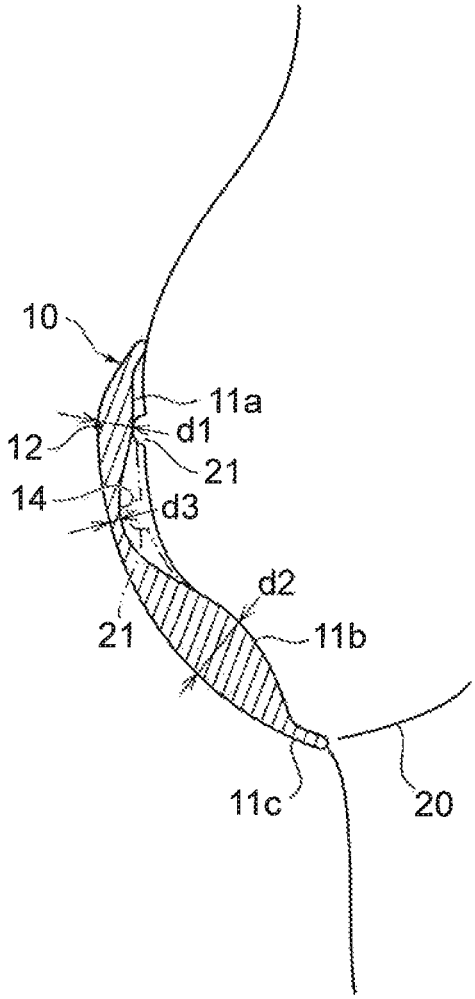
FIG. 2 is a sectional view of the cut part taken along the line II-II of FIG. 1.

The pair of left and right cup parts 10, 10 have structures substantially symmetrical to each other with respect to the front center. Therefore, the structure of one cup part 10 will be explained with reference to FIGS. 1 and 2. FIG. 2 is a sectional view of the cut part taken along the line II-II of FIG. 1. For explanation, FIG. 2 schematically illustrates a breast 20 at the time of putting on the brassiere $\mathbf{1}_1$.

The cup part 10 accommodates the breast 20 (see FIG. 2) of the wearer. The cup part 10 is formed by holding a core material covered with a covering cloth between a cup front cloth and a cup lining cloth. Usable as the core material are materials having shape retention and elasticity, such as nonwoven fabrics and foamed polyurethane. Usable as the cup front cloth and cup lining cloth are materials such as woven and knitted fabrics of synthetic and natural fibers. For representing characteristic features of the cup part 10, FIG. 2 illustrates a cross-sectional structure of the cup part 10 in which the core material, cup front cloth, cup lining cloth, and the like are depicted integrally.

The cup part 10 has first and second shaping regions 11*a*, 11*b* and a third region 11*c* which is a region located about them and thinner than each of the first and second shaping regions 11*a*, 11*b*. The third region 11*c* is a region covering the breast 20 about and between the first and second shaping regions 11*a*, 11*b*.

The first shaping region 11*a* is located at such a position as to cover a nipple 21 (see FIG. 2) at the time of putting the cup part 10 on the breast 20. The first shaping region 11*a* is a thicker part smoothly bulging on the skin side and presses the breast 20. An example of the form of the first shaping region 11*a* seen from the skin side is substantially elliptical as represented by a broken line in FIG. 1. However, the form of the first shaping region 11*a* is not limited in particular as long as it covers the nipple 21 at the time of putting on. A top 12 of the cup part 10 is located on the front face side within the first shaping region 11*a*. The top 12 may be located at or near a position on the front face side of the thickest part of the first shaping region 11*a*.

The second shaping region 11*b* is located closer to the lower edge 13 of the cup part 10 than is the first shaping region 11*a*. The second shaping region 11*b* is a thicker part smoothly bulging on the skin side. The second shaping region 11*b* presses the breast 20, so as to push it up. An example of the form of the second shaping region 11*b* seen from the skin side is substantially elliptical as represented by a broken line in FIG. 1. However, the form of the second shaping region 11*b* is not limited in particular as long as it contributes to pushing the breast 20 up. The thickness d2 of the thickest part in the second shaping region 20*a* is greater than the thickness d1 of the thickest part in the first shaping region 11*a*.

Letting V1 and V2 be the respective volumes of the first and second shaping regions 11*a*, 11*b*, the volume V2 of the second shaping region 11*b* is greater than the volume V1 of the first shaping region 11*a*. Specifically, the volume ratio (V2/V1) of the second shaping region 11*b* to the first shaping region 11*a* may be 3 or greater. In the cup part 10, the volume ratio between the first and second shaping regions 11*a*, 11*b* can be achieved by setting their thicknesses d1, d2 and areas such that the volume ratio (V2/V1) attains a desirable value. The volume ratio (V2/V1), which may be set appropriately according to the size of the cup part 10, is preferably less than 5. Since the volume V2 of the second shaping region 11*b* is greater than the volume V1 of the first shaping region 11*a*, the second shaping region 11*b* presses the breast 20 by a stronger force.

The second shaping region 11*b*, which is only required to be positioned lower than the first shaping region 11*a*, is preferably located closer to the back cloth part 2 than the front center within the cup part 10 or spread on the back cloth part 2 side in the cup part 10. This is because it can push the breast 20 up above the front center, so as to form a breast cleavage, while making the breast appear larger in volume. When the second shaping region 11*b* is positioned closer to the back cloth part 2, the center part of the first shaping region 11*a* is located closer to the front center than is the center part of the second shaping region 11*b*, so that a line connecting the respective center parts of the first and second shaping regions 11*a*, 11*b* tilts on the front center side toward the upper portion of the cup part 10.

As illustrated in FIG. 2, the cup part 10 has a groove 14 between the first and second shaping regions 11*a*, 11*b*. The groove 14, which is formed according to the forms of the first and second shaping regions 11*a*, 11*b*, extends horizontally, for example. It is sufficient for the groove 14 to have such a vertical width as to accommodate the nipple 21 therein. The groove 14 is a valley between the first and second shaping regions 11*a*, 11*b*, while the thickness d3 of the cup part 10 at the position of the groove part 14 is thinner than each of the first and second shaping regions 11*a*, 11*b*.

Therefore, in the structure of the cup part 10 in accordance with this embodiment, a thicker part having the maximum thickness d2, a thinner part having the thickness d3, and a thicker part having the maximum thickness d1 are formed in sequence from the center part of the second shaping region 11*b* to the center part of the first shaping region 11*a*.

The first and second shaping regions 11*a*, 11*b* can be produced by molding the core material such as to make it have the first and second thicker parts corresponding to the first and second shaping regions 11*a*, 11*b*. In the core material, the region other than the first and second thicker parts constitutes the thinner third region 11*c* about the first and second shaping regions 11*a*, 11*b*.

In the structure of the cup part 10, when the brassiere $\mathbf{1}_1$ is worn by the wearer, the second shaping region 11*b* presses the part lower than the nipple 21, so as to push the breast 20 up, thereby making it appear larger in volume, while the first shaping region 11*a* further presses the breast 20 to the skin side. Operations and effects of thus pressing the breast 20 at two positions with the first and second shaping regions 11*a*, 11*b* will be explained specifically in comparison with the prior art.

Conventional brassieres also have pushed the breast 20 up with a pushing part corresponding to the second shaping region 11*b*. Thus pushing the breast 20 up has produced voluminousness in the bust. However, the breast 20 increases its volume in the upper part of the cup when pushed up, so that the upper part of the cup is pushed by the pushed-up breast 20 to the obliquely lower side in front as seen from the wearer. As a result, the bust top descends in silhouette. This becomes remarkable in particular when the wearer sits down and so forth. This is because, when the wearer sits down, tensions are kept on the back side of the brassiere but tend to slacken on the chest side thereof.

In the brassiere $\mathbf{1}_1$ in accordance with this embodiment, by contrast, the second shaping region 11*b* presses the lower side of the breast 20 and thus can push the breast 20 up. When the second shaping region 11*b* presses the lower part on the side of the breast 20 in particular, the breast 20 is pushed up on the front center side as mentioned above. The first shaping region 11*a* covering the nipple 21 at the time of putting on further presses the breast 20. Since the breast 20 pushed up by the second shaping region 11*b* is thus pressed to the skin side at such a position as to cover the nipple 21 at the time of putting on, the top 12 on the front face side of the cup part 10 can be inhibited from descending. Therefore, even when the second shaping region 11*b* pushes the breast 20 up in order to make the bust appear higher, the top 12 of the cup part 10 can keep its position. Hence, the bust top position in silhouette can be made higher than conventionally possible. Thus, the brassiere $\mathbf{1}_1$ has an auxiliary shaping action for forming the bust top position in addition to the shaping action of the second shaping region 11*b* pushing the breast 20 up.

Since the groove 14 exists between the first and second shaping regions 11*a*, 11*b* in the brassiere $\mathbf{1}_1$, the nipple 21 tends to migrate to the groove 14 as represented by a dash-double-dot line in FIG. 2 when the wearer takes such actions as to lift arms, walk, and sit down. The nipple 21 within the groove 14 is vertically held between the first and second shaping regions 11*a*, 11*b* and thus becomes more stable. When wearing outerwear or the like, the bust top position in silhouette is located at the top 12 on the front face side of the cup part 10. The top 12 of the cup part 10 resides within the first shaping region 11*a*, while the first shaping region 11*a* has a pressing action, whereby the top 12 can be maintained at the position where it was when put on even when the breast 20 is pushed up by the second shaping region 11*b*. As a result, the bust top position in silhouette can be kept high even when the nipple 21 is migrated to the groove 14. The groove 14 also allows the cup part 10 to bend appropriately, thereby making it easier for the wearer to move.

In this embodiment, the brassiere 11 has been explained as that of a molded type. However, the brassiere as the women's garment with cup parts may be of a padded type instead of the molded type.

Figure 3:
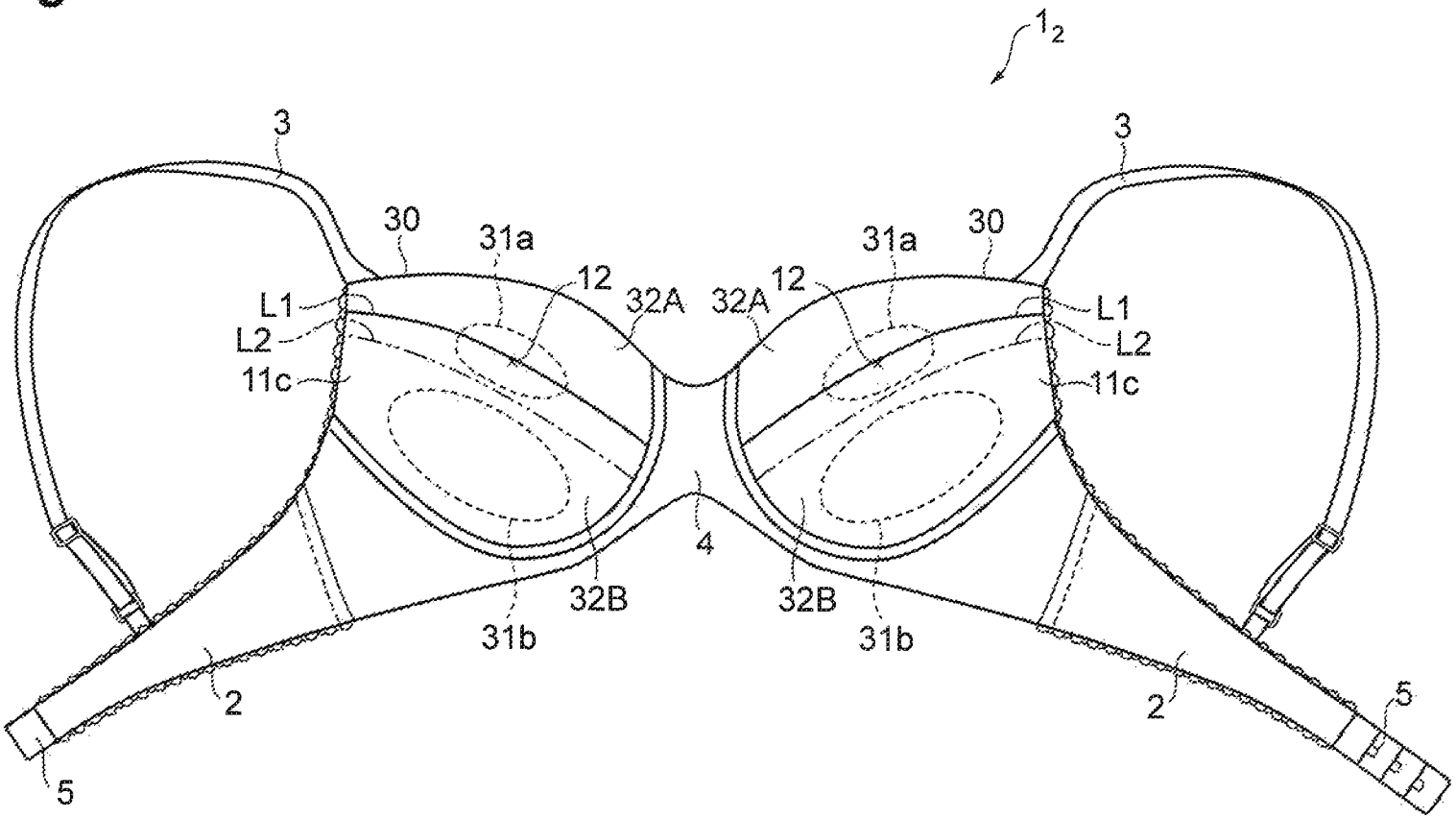
FIG. 3 is a front view of another embodiment of the women's garment with cup parts in accordance with the present invention.

FIG. 3 is a front view of a padded type brassiere. In the padded type brassiere $\mathbf{1}_2$ illustrated in FIG. 3, a cup part 30 incorporating a pad has first and second shaping regions 31*a*, 31*b* similar to the first and second shaping regions 11*a*, 11*b*. Arranged about the first and second shaping regions 31*a*, 31*b* is a third region 11*c* thinner than each of the first and second shaping regions 31*a*, 31*b* in the cup part 30, too. In the brassiere $\mathbf{1}_2$, the first and second shaping regions 31*a*, 31*b* are manufactured by using a pad having respective thicker parts corresponding to the first and second shaping regions 31*a*, 31*b*. The groove 14 is formed between the first and second shaping regions 31*a*, 31*b* on the skin side as in the brassiere $\mathbf{1}_1$ illustrated in FIG. 1.

Since the cup part 30 has the first and second shaping regions 31*a*, 31*b*, the brassiere $\mathbf{1}_2$ yields the same operations and effects as with the brassiere $\mathbf{1}_1$.

Since the brassiere $\mathbf{1}_2$ is of a padded type, the cup part 30 can have an upper cup part 32A and a lower cup part 32B as illustrated in FIG. 3. The upper cup part 32A and the lower cup part 32B are joined to each other along a joint line L1. The joint line L1 passes through the first region 31*a* on the front face of the cup part 30, while a top 31 on the front face side of the cup part 30 is located on the joint line L1.

In the conventional padded type brassieres, the cup part also has upper and lower cup parts, which are joined to each other. The top on the front face of the cup part is located on the joint line. Therefore, the lower cup part may be made larger simply in order for the bust top position in silhouette to look higher. When the lower cup part is made larger in order for the bust top position to look higher, however, the form of the lower cup part does not match that of the breast 20. This causes a gap (air space) between the cup part and the breast 20 at the position of the nipple 21 within the cup part, so that the breast 20 cannot be held stably, whereby no comfortable feel of wearing can be obtained. Hence, it has conventionally been impossible to make the lower cup part larger in order to raise the top position, which has resulted in a problem that the bust top position in silhouette cannot be made higher.

In the brassiere $\mathbf{1}_2$, by contrast, the joint line L1 traverses the first shaping region 31*a* on the front face of the cup part 30. Therefore, even when the lower cup part 32B is made larger, the nipple 21 can be supported stably at the time of putting on. Even when migrated to the groove 14 between the first and second shaping regions 31*a*, 31*b*, the nipple 21 is vertically held between the first and second shaping regions 31*a*, 31*b* and thus is stable, while the part of the breast 20 on the upper side of the nipple 21 is pressed by the first shaping region 31*a* bulging on the skin side, whereby no gap occurs. As a result, the brassiere $\mathbf{1}_2$ can attain the joint line $L_1$ located higher than a conventional joint line L2 represented by a dash-double-dot line in FIG. 3. Hence, the brassiere $\mathbf{1}_2$ can further make the bust top in silhouette look higher than conventionally possible.

EXAMPLES

Operations and effects of the women's garment with cup parts in accordance with the present invention will now be explained specifically with reference to examples. The women's garment with cup parts is a brassiere in the examples, too. Comparative Example was performed as well as Examples 1 and 2.

In Example 1, the brassiere $\mathbf{1}_1$ of the molded type explained with reference to FIGS. 1 and 2 was prepared. In the brassiere $\mathbf{1}_1$, a core material was molded so as to have first and second thicker parts corresponding to the first and second shaping regions 11*a*, 11*b*, thereby forming the first and second shaping regions 11*a*, 11*b* and the groove 14 therebetween.

In Example 2, the brassiere $\mathbf{1}_2$ of the padded type explained with reference to FIG. 3 was prepared. In the brassiere $\mathbf{1}_2$, a pad was formed with respective thicker parts corresponding to the first and second shaping regions 31*a*, 31*b*, so as to produce the first and second shaping regions 31*a*, 31*b* and the groove 14 therebetween.

As Comparative Example, a conventional product having no first shaping region 11*a* (or 31*a*) was prepared. The conventional product is "Shakitto Bra" (product number: BSB442) which is a brassiere available from the applicant.

(Results of Evaluating Bust Top Positions)

Examples 1 and 2 and Comparative Example were worn by the same monitor, their wearing states were photographed, and positions of the top 12 on the front face side of the cup parts 10, 30 in the wearing states were compared.

Figure 4:
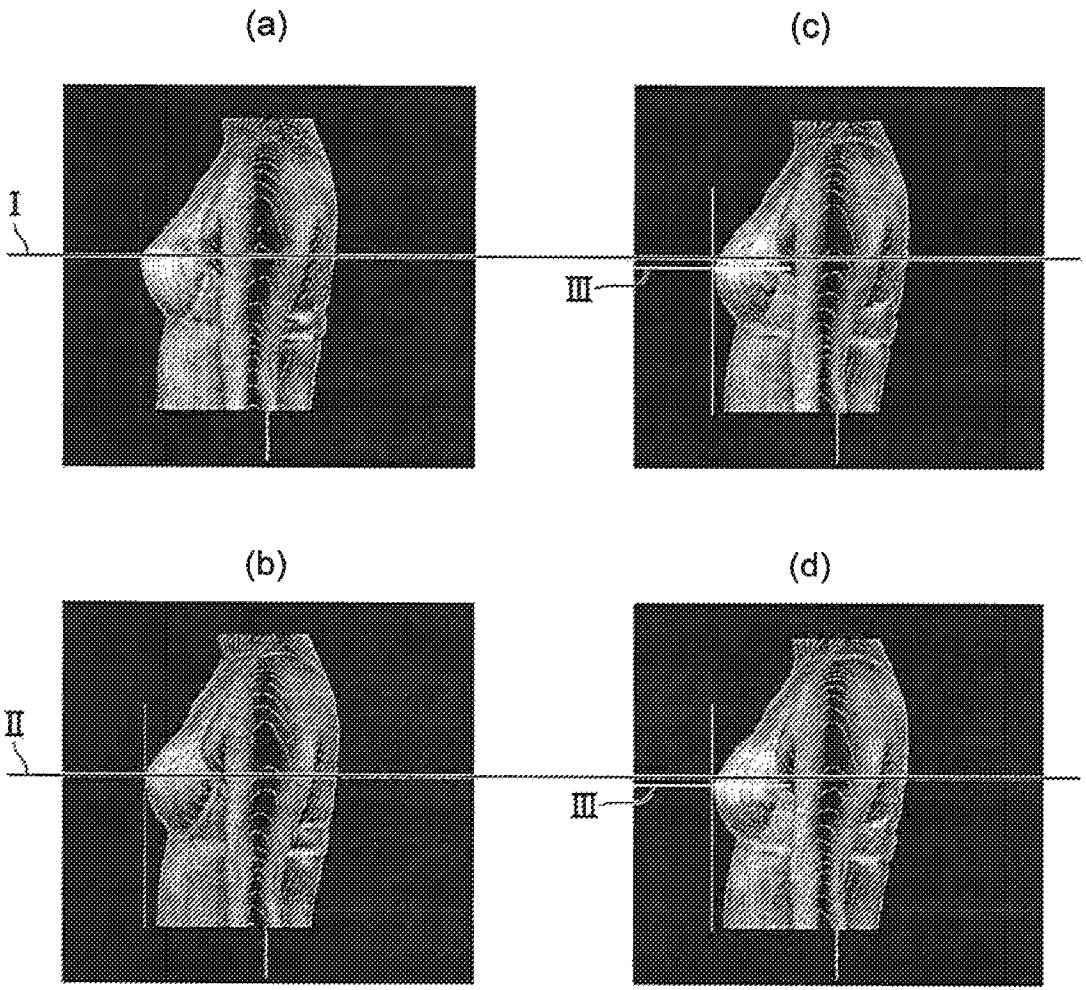
FIG. 4 is a set of charts illustrating results of comparisons between Examples 1 and 2 and Comparative Example.

FIG. 4 is a set of charts illustrating results of comparisons between Examples 1 and 2 and Comparative Example. Specifically, FIGS. 4(*a*) and (*b*) are charts in which moiré images are superposed on lateral photographs taken when wearing the brassieres $\mathbf{1}_1$, $\mathbf{1}_2$ of Examples 1 and 2. FIGS. 4(*c*) and (*d*) are charts in which moiré images are superposed on lateral photographs taken when wearing the conventional product as Comparative Example.

In FIG. 4, solid lines I, II represent the respective top positions on the front face of the cup part (bust top positions) in the states of wearing the brassieres $\mathbf{1}_1$, $\mathbf{1}_2$ of Examples 1 and 2. A solid line III in FIG. 4 represents the top position on the front face of the cup part (bust top position) in the state of wearing Comparative Example.

Comparisons of Examples 1 and 2 with Comparative Example reveal that Examples 1 and 2 can attain bust top positions higher than the bust top position of Comparative Example.

The present invention is not limited to the embodiments and examples explained in the foregoing. For example, each of the first and second shaping regions 11*a*, 11*b*, 31*a*, 31*b* may have the same thickness therewithin. Further, in this case, the first and second shaping regions 11*a*, 11*b* may have the same thickness, or the first and second shaping regions 31*a*, 31*b* may have the same thickness. When the first and second shaping regions 11*a*, 11*b*, 31*a*, 31*b* are thicker parts smoothly bulging on the skin side, the first and second shaping regions 11*a*, 11*b* may have the same maximum thickness, or the first and second shaping regions 31*a*, 31*b* may have the same maximum thickness. When the first and second shaping regions 11*a*, 11*b* have the same thickness, for example, a volume ratio (V2/V1) of 3 or greater may be attained by the difference in area between the first and second shaping regions 11*a*, 11*b*. This also holds in the first and second shaping regions 31*a*, 31*b*. Due to differences in volume ratios, the second shaping regions 11*b*, 31*b* can press the breast by stronger forces than the first shaping regions 11*a*, 31*a* do. The first and second shaping regions 11*a*, 11*b*, which are made of the same material in the above-mentioned embodiment, may be made of materials different from each other.

The groove 14, which has been explained as being formed between the first and second shaping regions 11*a*, 11*b*, 31*a*, 31*b*, may be omitted. Even in this case, the bust top position in silhouette can be made higher by the operations and effects of having the first shaping regions 11*a*, 31*a* as mentioned above.

As mentioned above, the forms of the first and second shaping regions 11*a*, 11*b* in the cup part 10 as seen from the skin side (or front face side) are not limited to those illustrated in FIG. 1, but may vary as long as the first shaping region 11*a* covers the nipple 21 at the time of putting on, while the second shaping region 11*b* is located lower than the first shaping region 11*a*.

FIGS. 5 to 8, which are plan views of the cup part 10 as seen from the front side, illustrate modified examples of the first and second shaping regions 11*a*, 11*b*. Since the pair of cup parts 10, 10 in the brassiere $\mathbf{1}_1$ are substantially symmetrical to each other with respect to the front center, each of FIGS. 5 to 8 illustrates only one (the left cup part as seen from the wearer) of the pair of cup parts 10, 10. In FIGS. 5 to 8, the cup part and the first and second shaping regions are referred to with the same signs as those in FIG. 1. The modified examples of the first and second shaping regions 11*a*, 11*b* will now be explained with a focus on their main differences.

Figure 5:
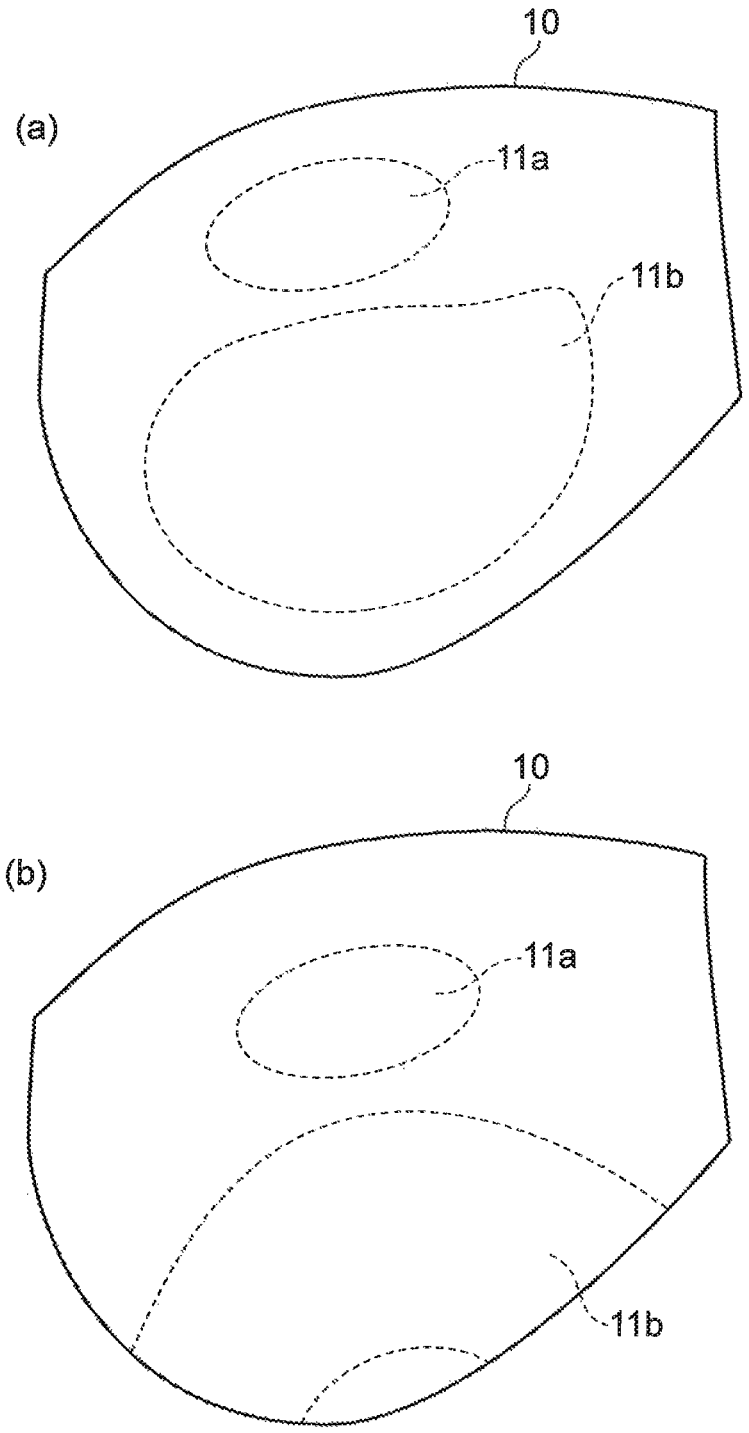
FIG. 5(*a*) is a diagram illustrating a modified example of first and second shaping regions, while FIG. 5(*b*) is a diagram illustrating another modified example of the first and second shaping regions.

As illustrated in FIG. 5(*a*), the second shaping region 11*b* may have a vertical width larger than that represented in FIG. 1. As illustrated in FIG. 5(*b*), the second shaping region 11*b* may be shaped into an arc convex to the first shaping region 11*a*.

Figure 6:
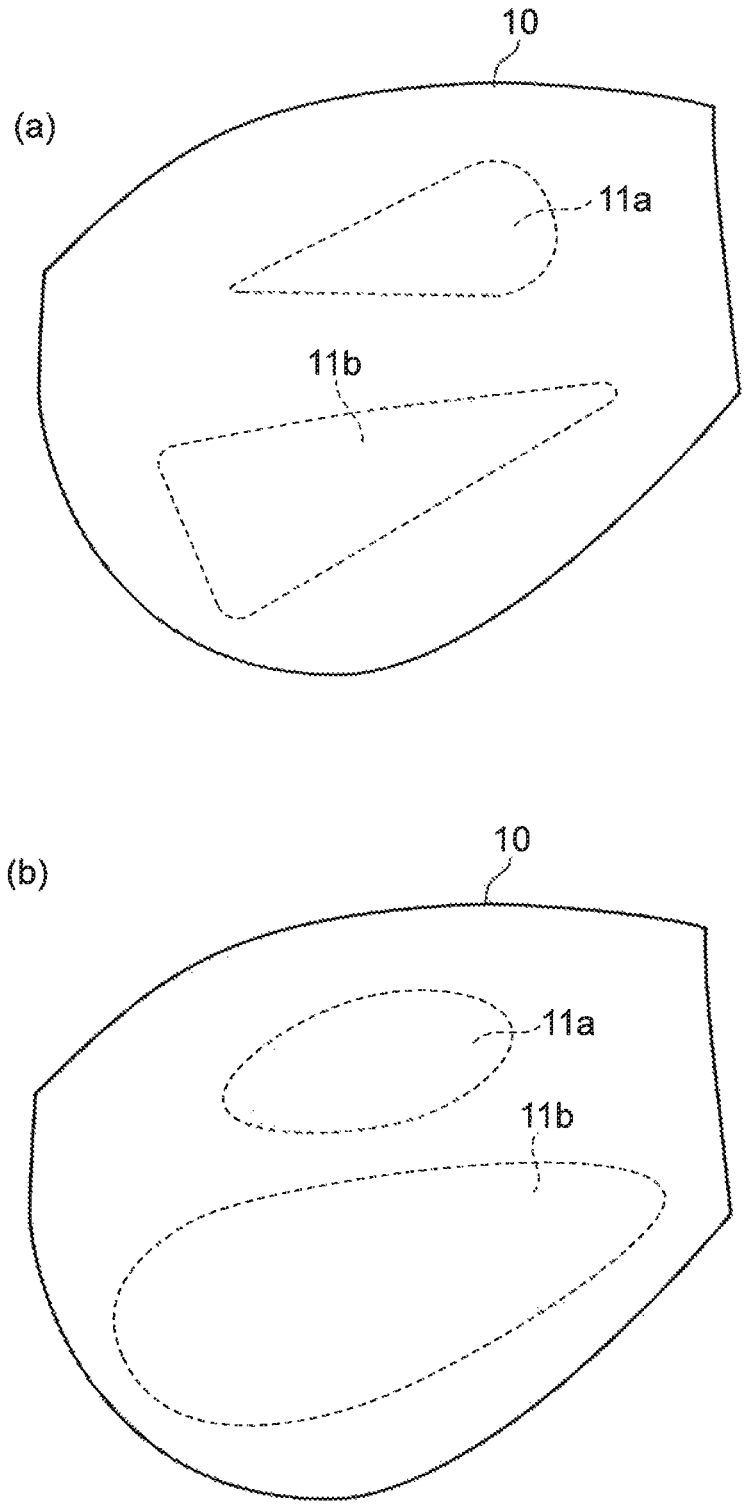
FIG. 6(*a*) is a diagram illustrating still another modified example of first and second shaping regions, while FIG. 6(*b*) is a diagram illustrating yet another modified example of the first and second shaping regions.

As illustrated in FIG. 6(*a*), each of the first and second shaping regions 11*a*, 11*b* may have a substantially triangular form tapering on one end side in a substantially horizontal direction. In this case, the respective base parts of the triangles of the first and second shaping regions 11*a*, 11*b* can be arranged opposite to each other as illustrated in FIG. 6(*a*). That is, as illustrated in FIG. 6(*a*), the first shaping region 11*a* tapers from the side (depicted right side) to the front center side (depicted left side), while the second shaping region 11*b* tapers from the front center side to the side. In FIG. 6(*b*), while the first shaping region 11*a* has a substantially elliptical form, the second shaping region 11*b* tapers from the front center side to the side as in FIG. 6(*a*). However, the second shaping region 11*b* has a streamline form more rounded than that illustrated in FIG. 6(*a*).

Figure 7:
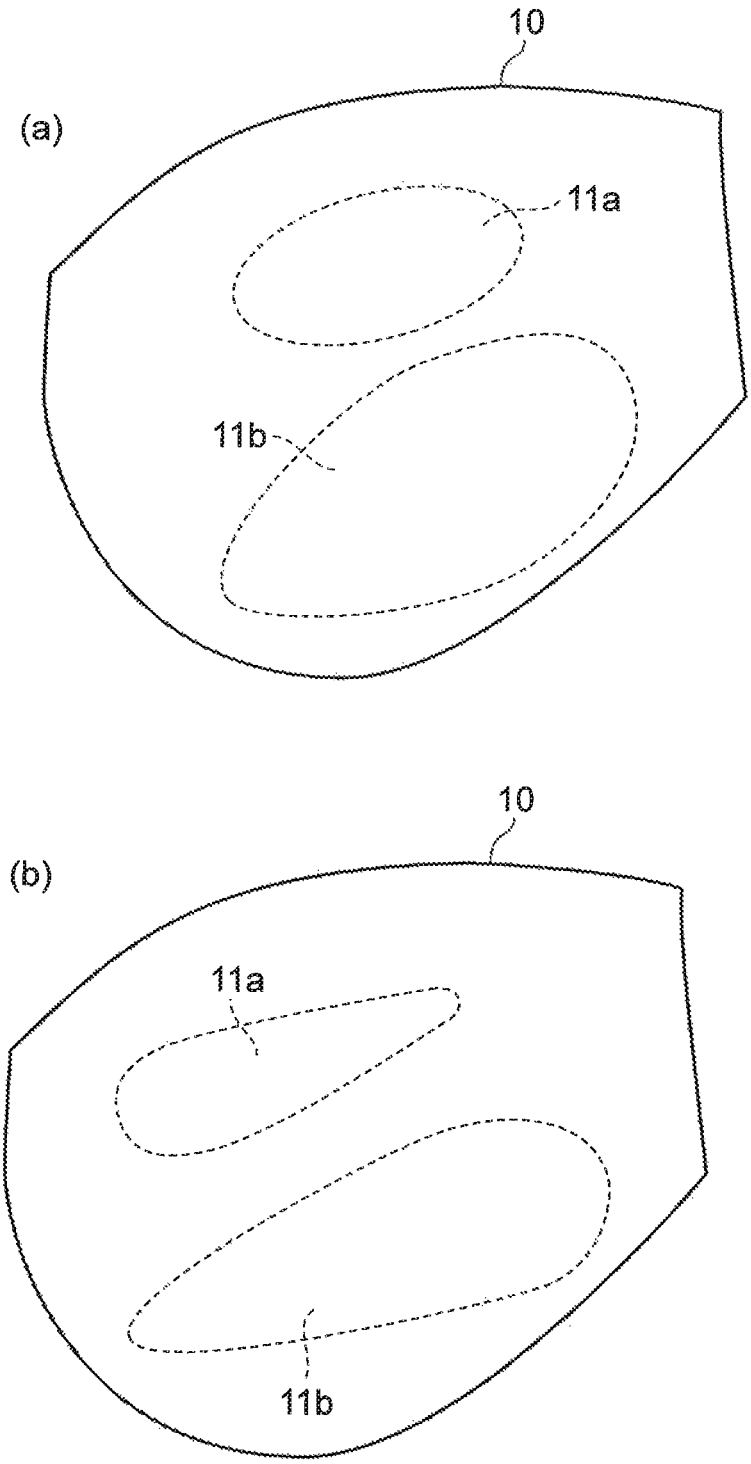
FIG. 7(*a*) is a diagram illustrating a further modified example of first and second shaping regions, while FIG. 7(*b*) is a diagram illustrating a still further modified example of the first and second shaping regions.
Figure 8:
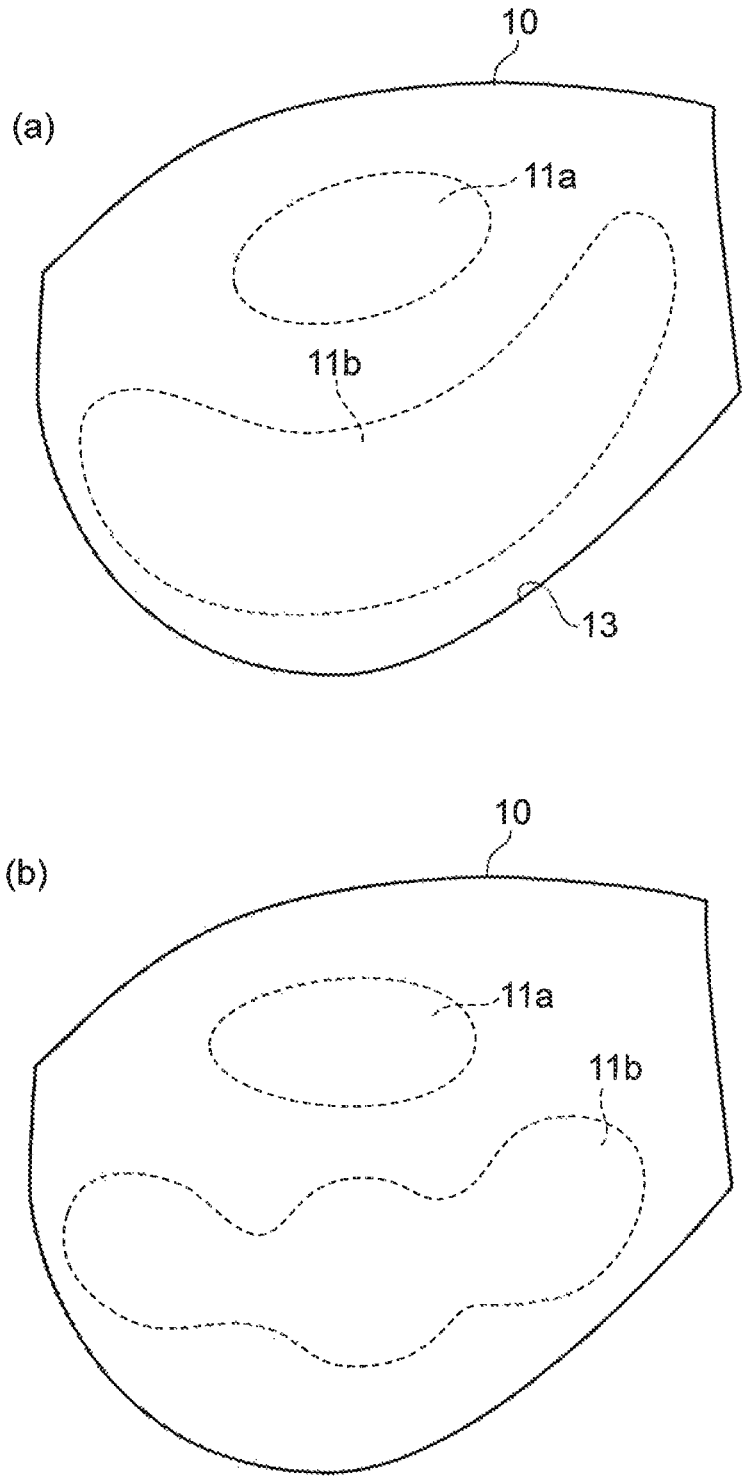
FIG. 8(*a*) is a diagram illustrating a yet further modified example of first and second shaping regions, while FIG. 8(*b*) is a diagram illustrating a furthermore modified example of the first and second shaping regions.

When the first and second shaping regions 11*a*, 11*b* taper on one end side in a substantially horizontal direction as illustrated in FIGS. 6(*a*) and (*b*), the tapered end parts may be located opposite from those in FIGS. 6(*a*) and (*b*) as illustrated in FIGS. 7(*a*) and (*b*). As illustrated in FIG. 8(*a*), the second shaping region 11*b* may be shaped into an arc convex to the lower edge 13. As illustrated in FIG. 8(*b*), the second shaping region 11*b* may have a form in which a plurality of elliptical or circular parts are joined together.

The modified examples of forms of the first and second shaping regions 11*a*, 11*b* in the cup parts 10 illustrated in FIG. 1 explained here are also applicable to the cup parts 30 illustrated in FIG. 3.

The brassieres $\mathbf{1}_1$, $\mathbf{1}_2$ have been explained as those of a type clasped on the back side by using the hooks 5, 5, but may also be of a so-called front hook type.

Though the women's garment with cup parts has been explained in terms of brassieres by way of example in the foregoing, the present invention is applicable to any of women's garments with a pair of cup parts, examples of which include bra slips, bra camisoles, bodysuits, and teddies with cup parts.

REFERENCE SIGNS LIST $\mathbf{1}_1$, $\mathbf{1}_2$ . . . brassiere (women's garment with cup parts); 2 . . . back cloth part; 3 . . . shoulder strap; 4 . . . base part; 5 . . . hook; 10, 30 . . . cup part; 11*a*, 31*a* . . . first shaping region; 11*b*, 31*b* . . . second shaping region; 32A . . . upper cup part; 32B . . . lower cup part; cup part 10, 12 . . . top on the front face side of the cup part; 14 . . . groove; 20 . . . breast; 21 . . . nipple

The invention claimed is:

1. A women's garment the garment comprising:

a pair of cup parts;

wherein each of the cup parts has an external surface comprising a front face side, an internal surface comprising a skin side, and a lower edge:

a first shaping region for pressing a breast, and for covering a nipple when putting the cup part on the breast; and a second shaping region, located closer to the lower edge of the cup part than the first shaping region, for pressing the breast;

wherein the second shaping region has a volume larger than that of the first shaping region; and wherein the cup part has a top on the front face side of the first shaping region when seen from the front face side;

wherein the first shaping region and the second shaping region have thicker parts bulging on the skin side of the cup part; and wherein the first shaping region is thinner than the second shaping region.

2. The women's garment according to claim 1, wherein a groove is formed on the skin side of the cup part between the first and second shaping regions.

3. The women's garment according to claim 1, wherein the cup part has a third region, surrounding the first shaping region and the second shaping region, that is thinner than the first shaping region.

4. The women's garment according to claim 2, wherein the cup part has a third region, surrounding the first shaping region and the second shaping region, that is thinner than the first shaping region.

5. The women's garment according to claim 1, comprising, a base part connected to the lower edges of the cup parts, the base part having a pair of side end parts, and a pair of back cloth parts, each back cloth part being connected to one of the side end parts of the base part, wherein, the second shaping region is located closer to the back cloth part than a center of the front face side of the cup part.

6. The women's garment according to claim 5, wherein the first shaping region has a first shaping region center part on the front face side of the cup part, and the second shaping region has a second shaping region center part on the front face side of the cup part, wherein the first shaping region center part is located closer to the center of the front face side than is the second shaping region center part.

7. The women's garment according to claim 2, comprising, a base part connected to the lower edges of the cup parts, the base part having a pair of side end parts, and a pair of back cloth parts, each back cloth part being connected to one of the side end parts of the base part, wherein, the second shaping region is located closer to the back cloth part than a center of the front face side of the cup part.

8. The women's garment according to claim 7, wherein the first shaping region has a first shaping region center part on the front face side of the cup part, and the second shaping region has a second shaping region center part on the front face side of the cup part, wherein the first shaping region center part is located closer to the center of the front face side than is the second shaping region center part.

9. The women's garment according to claim 2, comprising, a base part connected to the lower edges of the cup parts, the base part having a pair of side end parts, and a pair of back cloth parts, each back cloth part being connected to one of the side end parts of the base part, wherein, the second shaping region is located closer to the back cloth part than a center of the front face side of the cup part.

10. The women's garment according to claim 9, wherein the first shaping region has a first shaping region center part on the front face side of the cup part, and the second shaping region has a second shaping region center part on the front face side of the cup part, wherein the first shaping region center part is located closer to the center of the front face side than is the second shaping region center part.

11. The women's garment according to claim 4, comprising, a base part connected to the lower edges of the cup parts, the base part having a pair of side end parts, and a pair of back cloth parts, each back cloth part being connected to one of the side end parts of the base part, wherein, the second shaping region is located closer to the back cloth part than a center of the front face side of the cup part.

12. The women's garment according to claim 11, wherein the first shaping region has a first shaping region center part on the front face side of the cup part, and the second shaping region has a second shaping region center part on the front face side of the cup part, wherein the first shaping region center part is located closer to the center of the front face side than is the second shaping region center part.

13. The women's garment according to claim 9, wherein the form of the first shaping region seen from the skin side of the cup part is substantially elliptical or substantially triangular and the form of the second shaping region seen from the skin side of the cup part is substantially elliptical or substantially triangular.

14. The women's garment according to claim 10, wherein the form of the first shaping region seen from the skin side of the cup part is substantially elliptical or substantially triangular and the form of the second shaping region seen from the skin side of the cup part is substantially elliptical or substantially triangular.

15. The women's garment according to claim 11, wherein the form of the first shaping region seen from the skin side of the cup part is substantially elliptical or substantially triangular and the form of the second shaping region seen from the skin side of the cup part is substantially elliptical or substantially triangular.

16. The women's garment according to claim 12, wherein the form of the first shaping region seen from the skin side of the cup part is substantially elliptical or substantially triangular and the form of the second shaping region seen from the skin side of the cup part is substantially elliptical or substantially triangular.

* * * * *

UNITED STATES PATENT AND TRADEMARK OFFICE

CERTIFICATE OF CORRECTION

PATENT NO. : 9,011,199 B2
APPLICATION NO. : 13/638104
DATED : April 21, 2015
INVENTOR(S) : Yuasa et al.

It is certified that error appears in the above-identified patent and that said Letters Patent is hereby corrected as shown below:

On the title page change item (76) to item (75)

Insert the assignee item --(73) WACOAL CORP--

Signed and Sealed this
Twenty-third Day of February, 2016

Michelle K. Lee

Michelle K. Lee
*Director of the United States Patent and Trademark Office*